US007573003B2

(12) United States Patent
Grätz et al.

(10) Patent No.: US 7,573,003 B2
(45) Date of Patent: Aug. 11, 2009

(54) COOKTOP WITH TEMPERATURE SENSOR

(75) Inventors: Franz Grätz, Traunwalchen (DE); Uwe Has, Unterneukirchen-Oberschroffen (DE); Dan Neumayer, Bernau (DE); Markus Theine, Freilassing (DE); Peter Vetterl, Grabenstätt (DE); Monika Zeraschi, Traunreut (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1729 days.

(21) Appl. No.: 10/223,041

(22) Filed: Aug. 16, 2002

(65) Prior Publication Data

US 2003/0019863 A1 Jan. 30, 2003

Related U.S. Application Data

(63) Continuation of application No. PCT/EP01/01428, filed on Feb. 9, 2001.

(30) Foreign Application Priority Data

Feb. 16, 2000 (DE) ..... 100 06 974

(51) Int. Cl.
*H05B 3/68* (2006.01)

(52) U.S. Cl. ..... 219/448.17; 219/448.11

(58) Field of Classification Search ..... 219/446.1, 219/447.1, 448.11, 448.12, 448.14, 448.16, 219/448.18, 448.19, 458.1, 460.1, 461.1; 136/221, 230, 231

See application file for complete search history.

(56) References Cited

U.S. PATENT DOCUMENTS

| | | | | |
|---|---|---|---|---|
| 3,622,754 | A | 11/1971 | Hurko | |
| 4,241,289 | A * | 12/1980 | Bowling | 219/448.14 |
| 4,447,710 | A | 5/1984 | McWilliams | |
| 4,851,645 | A | 7/1989 | Wolf et al. | |
| 5,176,451 | A * | 1/1993 | Sasada et al. | 374/179 |
| 5,877,475 | A * | 3/1999 | Hecht et al. | 219/448.11 |

FOREIGN PATENT DOCUMENTS

| | | |
|---|---|---|
| DE | 77 32 760 U1 | 10/1977 |
| DE | 27 47 652 A1 | 4/1979 |
| DE | 81 09 131.1 U1 | 8/1981 |
| DE | 37 39 943 C2 | 6/1988 |
| DE | 37 03 768 A1 | 8/1988 |
| EP | 0 021 107 A1 | 1/1981 |
| EP | 0 943 870 A1 | 9/1999 |

* cited by examiner

*Primary Examiner*—Sang Y. Paik
(74) *Attorney, Agent, or Firm*—Laurence A. Greenberg; Werner H. Stemer; Gregory L. Mayback

(57) ABSTRACT

In a cooktop with a cooktop panel, beneath which at least one heating element is disposed for heating up a cooking vessel to be placed on the cooktop panel, and with a temperature sensor for sensing the temperature of the cooktop panel, which temperature sensor is in heat-conducting contact with the underside of the cooktop panel within the heating element and is connected to a control unit for controlling the heating power of the heating element, to simplify assembly/fitting, the invention provides a heat-conducting element within the heating element in heat-conducting contact with the underside of the cooktop panel, and fastens the temperature sensor in this region to the heat-conducting element.

20 Claims, 3 Drawing Sheets

COOKTOP WITH TEMPERATURE SENSOR

CROSS-REFERENCE TO RELATED APPLICATION

This application is a continuation of copending International Application No. PCT/EP01/01428, filed Feb. 9, 2001, which designated the United States and was not published in English.

BACKGROUND OF THE INVENTION

Field of the Invention

The present invention relates to a cooktop or hob with a cooktop panel, beneath which at least one heating element is disposed for heating up a cooking vessel that can be placed on the cooktop panel, and with a temperature sensor for sensing the temperature of the cooktop panel, which temperature sensor is in heat-conducting contact with the underside of the cooktop panel within the heating element and is connected to a control unit for controlling the heating power of the heating element, and also relates to a corresponding heating element and a suitable element.

German Patent DE 37 03 768 C2, corresponding to U.S. Pat. No. 4,851,645 to Wolf et al., discloses a cooktop having a device for sensing the temperature of a glass-ceramic panel heated up by heating windings or halogen lamps with a temperature sensor. The sensor emits a signal corresponding to the temperature of the glass ceramic for a control circuit. The heating windings or halogen lamps are disposed in the interior space of a cup-like insulating base and heat up the glass-ceramic panel by direct radiation. The edge of the insulating base bears under resilient stress against the underside of the glass-ceramic panel, and the temperature sensor is disposed outside the interior space of the insulating base, but within the heating element. The temperature sensor is also in heat-conducting connection with the underside of the glass-ceramic panel, the temperature sensor being disposed in a receptacle in the edge of the insulating base. The receptacle is disposed at a distance x from the inner side of the edge of the insulating base, the minimum value of which is chosen such that the brief temperature changes arising when the heating windings or halogen lamps are switched on and off have only a negligible influence on the temperature sensor. The maximum value of the distance x is chosen such that the delay caused by the thermal conductivity of the glass-ceramic panel produces a small hysteresis in the control characteristic. Widths of from 3 mm to 6 mm have proven to be advantageous as the distance x. The temperature sensor is fitted in the receptacle that has been made or pressed into the upper side of the attachment that protrudes into the interior space of the insulating base, and is in heat-conducting connection with the underside of the glass-ceramic panel. The temperature sensor is held indirectly under resilient stress against the underside of the glass-ceramic panel, to keep the heat transfer resistance between the glass-ceramic panel and the temperature sensor small.

Furthermore, European Patent Application EP 0 021 107 A1 discloses a heating element for a cooking unit with a temperature sensor. To maintain complete heating of the entire surface area of the heating element, and, nevertheless, couple the temperature sensor of the controller closely to the heating device, a heat-transfer element in the form of a metal sheet is used, the sheet being disposed between the heating elements and the glass-ceramic panel such that it partly covers the heated region, but protrudes from the heating element and is in connection there with the temperature sensor of the controller. The heat-transfer element is fastened by secure clamping on the edge of the shell carrying the heating device and normally bears against the underside of the glass-ceramic panel. An outer portion protrudes from the heat-sensing region of the heat-transfer element outward beyond the edge of the heating element. It is formed in one piece with the aforementioned region, is substantially parallel to the latter, but offset downward somewhat by a bend, so that the outer portion does not bear against the underside of the glass-ceramic panel. The sensor cell of the temperature sensor is pressed by a compression spring against the underside of the heat-transfer face of the heat-transfer element, which is supported on a holding mechanism that guides the sensor cell and is attached to the outer portion of the heat-transfer element. However, other types of sensor and ways of attaching it are also possible. For example, an electrical NTC or PTC sensor, which is pressed resiliently into contact or securely attached to the outer portion of the heat-transfer element, may also be used. The transfer element can be grounded if desired, providing protection against electric shock.

Furthermore, U.S. Pat. No. 4,447,710 to McWilliams discloses a glass-ceramic cooktop in which an insulator on which a temperature sensor, for example, a thermocouple, is mounted is disposed in the edge region of the heating element. The thermocouple is kept in good thermal contact with the underside of the glass-ceramic panel by the insulating block.

SUMMARY OF THE INVENTION

It is accordingly an object of the invention to provide a cooktop with temperature sensor that overcomes the hereinafore-mentioned disadvantages of the heretofore-known devices of this general type and that has good measuring accuracy while being easy to fit.

With the foregoing and other objects in view, there is provided, in accordance with the invention, a cooktop, including a cooktop panel having an underside, at least one heating element disposed beneath the cooktop panel for heating up a cooking vessel to be placed on the cooktop panel, a control unit electrically connected to the at least one heating element for controlling a heating power of the at least one heating element, a temperature sensor sensing a temperature of the cooktop panel, the temperature sensor in heat-conducting contact with the underside of the cooktop panel within the at least one heating element, and electrically connected to the control unit, a heat-conducting element at least partially disposed within the at least one heating element and in heat-conducting contact with the underside of the cooktop panel at a region of the cooktop panel, and the temperature sensor fastened to the heat-conducting element in the region of the cooktop panel.

The invention provides a cooktop where a heat-conducting element within the heating element is in heat-conducting contact with the underside of the cooktop panel, and the temperature sensor is fastened in this region to the element. According to the invention, a corresponding heating element and also an element for the heating element are further provided. By sensing the cooktop temperature within the heating element, in the edge region of the cooktop, good measuring accuracy can be achieved. By fastening the temperature sensor to the element, the relative position of the temperature sensor with respect to the heat-conducting element and their heat-conducting behavior can be precisely fixed. Furthermore, a structural unit that can be pre-assembled and pretested and is also easy to handle technically in terms of assembly/fitting, because it is quite large and stable, is provided.

When fitting the configuration on the heating element, according to the invention, it only remains to-ensure error-free fastening of the element to the heating element. The thermal coupling of the heat-conducting element to the underside of the cooktop panel within the heating element and the simultaneous fastening of the temperature sensor to the element have the effect that the temperature sensor is optimally coupled to the cooktop panel or to a cooking pot placed on it, while also being easy to position and easy to fit.

In accordance with another feature of the invention, the temperature sensor is disposed in the region of a temperature limiter of the heating element. As a result, on one hand, all the electrical connections are disposed spatially together on the heating element in a way that is favorable technically in terms of assembly/fitting and, on the other hand, the respective minimum distances of the electrical connections from one another are maintained in conformity with the relevant VDE [German association of electrical engineers] regulations.

In accordance with a further feature of the invention, to allow the heat-conducting element to be fitted quickly and without any errors, the heat-conducting element is fastened, in particular, screwed, in the region of the outer circumferential wall of the heating element or of the insulating base directly or with the aid of an intermediate fitting part. In such a case, it may be provided, in particular, that the intermediate fitting part is fastened in an easy way in the bottom region of the heating element and extends into the region of the outer circumferential wall of the heating element, in which the element is, in turn, screwed to the intermediate fitting part. To allow good setting of the bearing pressure or bearing area of the element, and consequently, inter alia, the thermal coupling of the element to the underside of the cooktop panel, the element can be screwed on the outer circumferential wall of the heating element at various heights.

In accordance with an added feature of the invention, the temperature sensor is fastened on the underside of the element. As a result, on one hand, a large and planar resting area can be realized, to improve the heat conduction from the underside of the glass ceramic panel to the temperature sensor. On the other hand, the temperature sensor is mechanically protected better by the element of a larger surface area in the fitting process, for example, in the event of the element/temperature sensor unit falling down.

In accordance with an additional feature of the invention, to make fitting easier, the element may have a receiving portion for the temperature sensor and a fitting portion for the fastening of the element, in particular, on the heating element, the receiving portion being radially offset laterally with respect to the fitting portion. This is important, in particular, whenever the temperature sensor is to be fitted in the direct vicinity of a temperature limiter usually present at the heating element. This is because the temperature limiter restricts the fitting space in the region of the outer circumferential wall of the heating element; on the other hand, however, it is favorable if the various electrical connections of the temperature limiter and of the temperature sensor are as close together as technical safety considerations allow.

In accordance with yet another feature of the invention, the element is advantageously formed in at least two parts. A receiving part for the temperature sensor is, in this case, of a softer material, to allow the receiving part to be geometrically shaped optimally, with specific regard to technical aspects of the application and safety. It should also be ensured that the thermal conductivity of the material used is adequate. The rest of the element may be of another material, for example, a harder material, a spring material being suitable, in particular, to allow the element to be pressed in a defined manner against the underside of the glass-ceramic panel.

In accordance with yet a further feature of the invention, it is particularly favorable from technical aspects of production and assembly/fitting if the element is formed as a torsion spring, the torsion region of the spring element being provided substantially outside the heating element and, consequently, in a cooler region.

In accordance with yet an added feature of the invention, the element is formed such that it is electrically conductive and is grounded, to conform optimally to the safety regulations in a simple construction.

In accordance with yet an additional feature of the invention, to obtain adequate measuring accuracy, both the temperature sensor and the element are adequately shielded by an insulator against thermal radiation emanating from a heating device of the heating element.

In accordance with again another feature of the invention, to make fitting easier, and, in particular, for strain relief, the electrical lines of the temperature sensor are connected to a first connection portion of the element or a connection piece mounted there. In a corresponding way, the element may also have a second connection portion, to which a ground line of the element is connected.

In accordance with again a further feature of the invention, the heat-conducting element is a removable part of the at least one heating element.

With the objects of the invention in view, in a cooktop having a cooktop panel with an underside, at least one heating element disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel, in heat-conducting contact with the underside of the cooktop panel within the at least one heating element, and electrically connected to the control unit, there is also provided a temperature sensor holder including a heat-conducting element at least partially disposed within the at least one heating element and in heat-conducting contact with the underside of the cooktop panel at a region of the cooktop panel, and the temperature sensor fastened to the heat-conducting element in the region of the cooktop panel.

With the objects of the invention in view, in a cooktop having a cooktop panel with an underside, a control unit, and a temperature sensor in heat-conducting contact with the underside of the cooktop panel, electrically connected to the control unit, and sensing a temperature of the cooktop panel, there is also provided a heater including at least one heating element disposed beneath the cooktop panel for heating up a cooking vessel to be placed on the cooktop panel and electrically connected to the control unit for controlling a heating power of the at least one heating element, the temperature sensor in heat-conducting contact with the underside of the cooktop panel within the at least one heating element, a heat-conducting element at least partially disposed within the at least one heating element and in heat-conducting contact with the underside of the cooktop panel at a region of the cooktop panel, and the temperature sensor fastened to the heat-conducting element in the region of the cooktop panel.

Other features that are considered as characteristic for the invention are set forth in the appended claims.

Although the invention is illustrated and described herein as embodied in a cooktop with temperature sensor, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
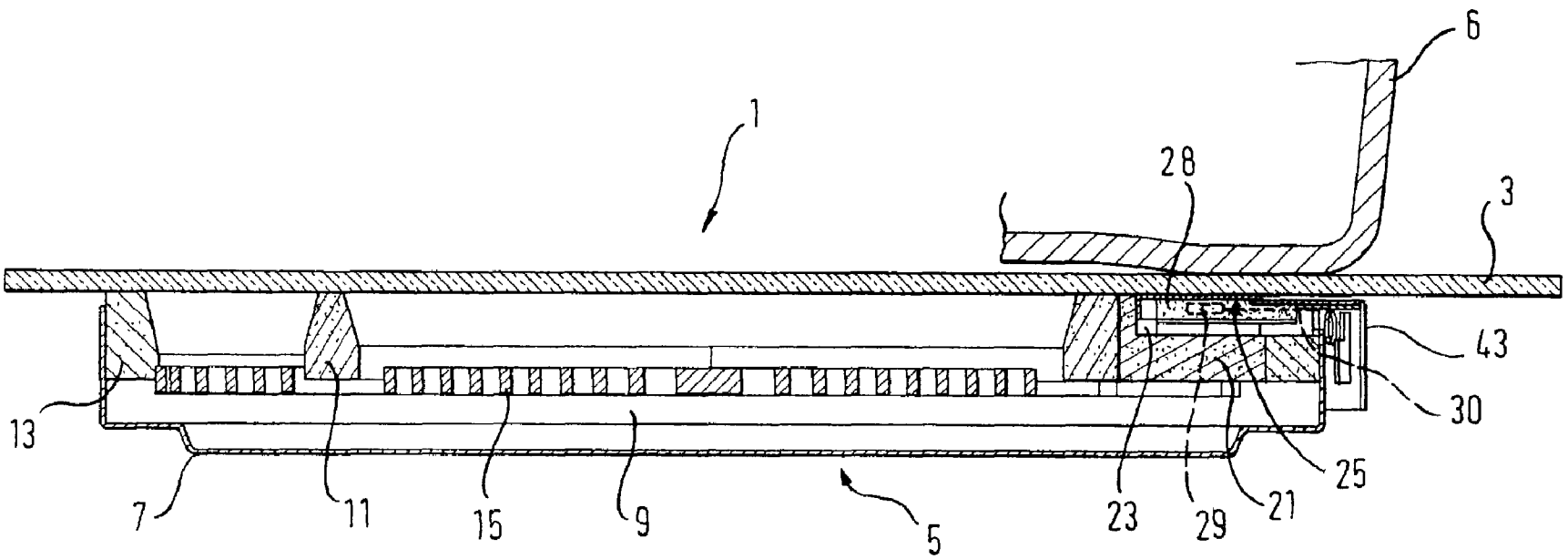
FIG. 1 is a fragmentary, cross-sectional view through line I-I in FIG. 2 of a cooktop with a heating element according to the invention.
Figure 2:
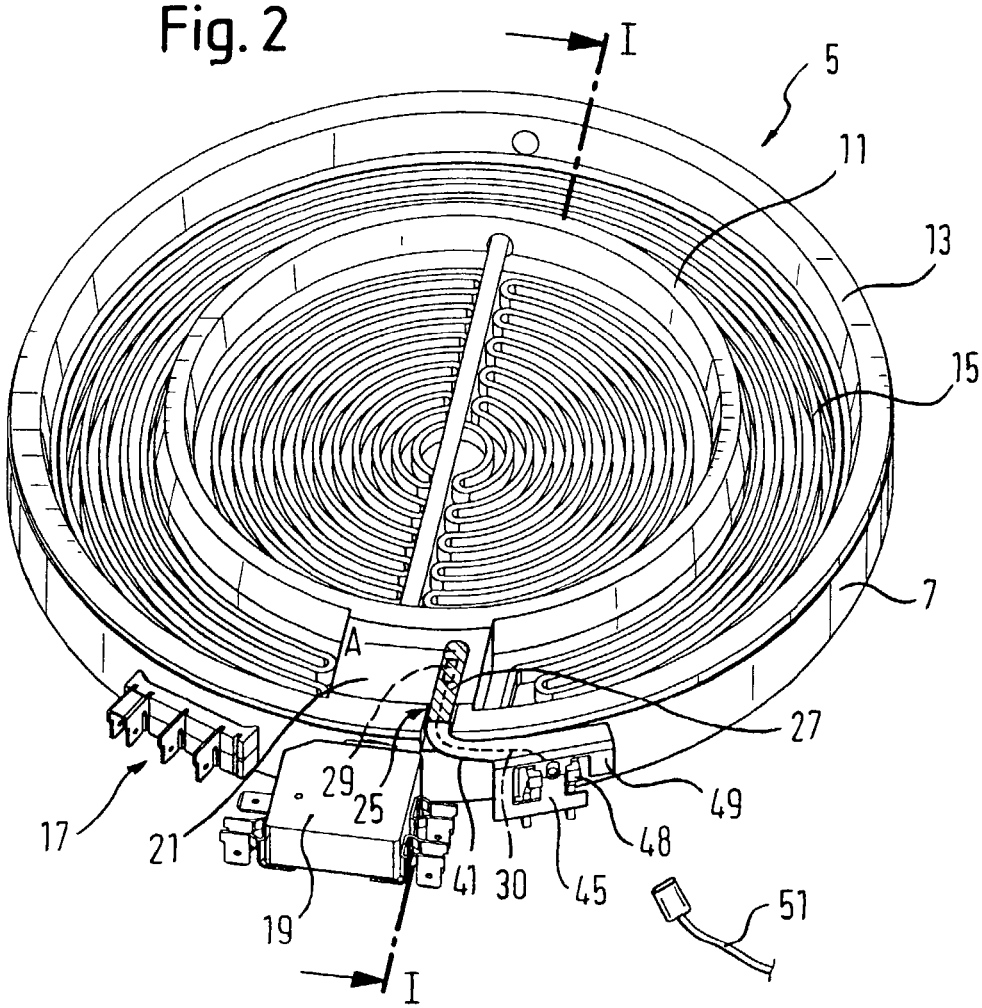
FIG. 2 is a partial fragmentary, perspective view from above of a heating element according to the invention.
Figure 3:
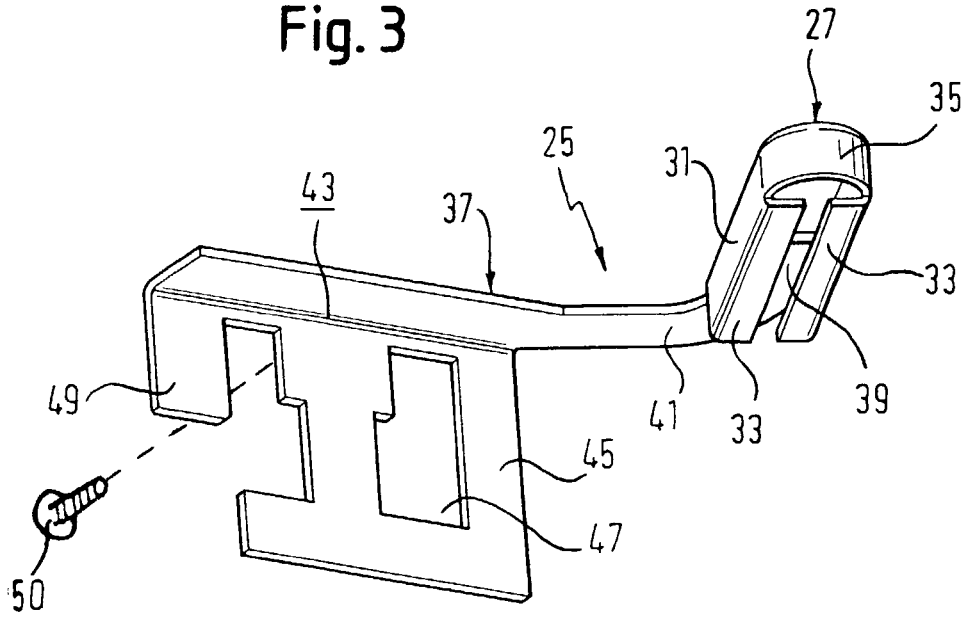
FIG. 3 is an enlarged, perspective view from below of a heat-conducting element from FIGS. 1 and 2 without a temperature sensor.

Referring now to the figures of the drawings in detail and first, particularly to FIG. 1 thereof, there is shown a cooktop 1 with a cooktop panel 3 (FIG. 1), made, in particular, of glass ceramic. Provided beneath the cooktop panel 3, in a conventional way, are various heating elements 5 of the cooktop, which are pressed in a conventional way (not shown) against the underside of the cooktop panel 3. In the region of the heating element 5, the cooktop panel 3 is usually decorated appropriately on its upper side. In the heated region, a cooking vessel 6 can be placed. In the cold state, the bottom of the cooking vessel 6 often rests on the cooktop panel 3 only in an annular area in the edge region of the heating element 5, while in the remaining central region of the bottom of the pot it is kept at a distance away from the panel by an air gap (see FIG. 1). In the heated state, the air gap is reduced or ideally approaches zero as a result of the conventional, thermally induced movement of the bottom of the pot. The heating element 5 has a dish-like sheet-metal cup 7, in which a circular disk-shaped insulating panel 9 lies. Furthermore, an inner insulating ring 11 and an outer insulating ring 13 are provided within the sheet-metal cup 7, on the insulating panel 9 in a way corresponding to a two-circuit heating configuration. As a result, the interior space of the heating element 5 is separated into an inner heating region and an outer heating region, in which a strip heating conductor 15 respectively extends (FIGS. 1 and 2). In a conventional way, fastened in the region of the outer circumferential wall of the sheet-metal cup 7 is a heating-conductor connection part 17, which, on one hand, is connected in a conducting manner to the strip heating conductors 15 and, on the other hand, can be connected to electrical supply lines (not shown) of the cooktop 1 (FIG. 2). The heating element 5 also has a conventional temperature limiter 19, the bar of which extends transversely over the heated region of the heating element. The connection block of the temperature limiter 19 has the conventional and customary, laterally brought-out flat contact pins for connection to the voltage supply line or to the heating-conductor connection part 17 of the heating element 5. An insulating block 21 is disposed between the inner insulating ring and the outer insulating ring 13 in the region of the temperature limiter 19. The insulating block 21 may serve the purpose of thermally shielding the temperature limiter 19 in the region of portions of the strip heating conductor 15 taken underneath the insulating block 21 with respect to these portions. A receiving depression 23 has been milled into the edge region of the insulating block 21, in the upper side of the latter. See, i.e., FIG. 4. In the depression 23, a heat-conducting element 25 is disposed with its element shroud 27 (FIGS. 1, 2, and 3). It should be ensured, in this respect, that the shroud 27 does not rest directly on the bottom of the depression 23 so that the shroud 27 can yield slightly in the event of the cooktop panel 3 being subjected to impact. The yielding allows damage to or breakage of the panel 3 to be avoided, in particular, if it is made of glass or glass-ceramic material.

Figure 5:
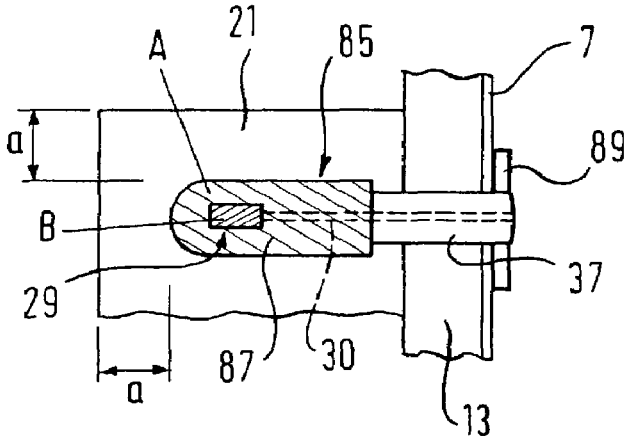
FIG. 5 is a simplified, fragmentary, cross-sectional view of a portion of a third embodiment of the heating element of FIGS. 1 and 2.

A PT-500 measuring sensor 29 is embedded with its sensor lines 30 in the receiving space formed by the element shroud 27, by a temperature-resistant and heat-conducting ceramic adhesive 28, and is fastened and guided in this way. The material of the element shroud 27 is X7 steel and the shroud 27 is configured in respect thereto as a bending part. The shroud material must have adequately good heat-conducting properties and must be able to deform well, as explained below, but be adequately stable mechanically in the entire temperature range of up to 350-400° C., and retain its properties even at these temperatures. From the portion of the element shroud 27 serving as a top wall there are two side walls 31 bent away downward substantially at right angles (FIG. 3). Likewise bent away at right angles with respect to the side walls 31, bottom walls 33 delimit a base of the element shroud 27 that is open in a slit-shaped manner. At the end face, the receiving space of the shroud is closed by an end wall 35, which is bent away at right angles from the top wall. It is ensured by the shroud-shaped construction of the element 25 that the clearance and leakage distance from the live temperature sensor 29 prescribed by safety regulations are maintained in the event of breakage of the cooktop panel 3, without the base area of the element 25 or of the shroud 27, and, consequently, of the insulating block 21, having to be made all that large. More precise details on the geometrical construction and configuration of the temperature sensor 29, of the element 25, and of the insulating block 21 are given in connection with the description of the third exemplary embodiment, sketched in FIG. 5. The shroud 27 is securely connected, preferably, welded, to a steel shroud support 37, having a substantially L-shaped construction. For such a purpose, the element shroud 27 is mounted on a connecting portion 39 of the shroud support 37 (FIG. 3). As a result, the top wall of the element shroud 27 is slightly elevated with respect to the upper side of the shroud support 37 and defines and delimits an area region A in which the element 25 bears in a heat-conducting manner against the underside of the cooktop panel 3 (FIGS. 1, 2, and 5). The overlapping connection of the shroud 27 and shroud support 37 also increases the stability of the connection. While the shroud support 37 is of a material 0.8 mm thick, to conform to regulations for the plug-in grounding connections described below, the element shroud 27 is of a thinner material, which, additionally, makes it easier to shape.

The shroud support 37 merges in a resilient portion 41 with a fitting portion 43 (FIGS. 2 and 3). In such a case, the resilient portion 41 is disposed substantially outside the heated region of the heating element 5 or of the outer insulating ring 13. The fitting portion 43 of the shroud support 37 has a fitting plate 45, which is bent away downward at right angles and has fitting openings 47. The fitting openings 47 allow the heat-conducting element 25 to be fastened adjustably in height on the outer circumferential wall of the sheet-metal cup 7 by an intermediate fitting part 48 (FIG. 2). For such a purpose, it is provided that the intermediate fitting part 48 is, on one hand, screwed on the underside of the sheet-metal cup 7 in the base thereof (not shown). The fitting part 48 extends in an approximately L-shaped manner from the base of the heating element up to its side wall 7. In the side wall region, the heat-conducting element 25 is then screwed to (see, i.e., screw 50 in FIG. 3) the intermediate fitting part 48 and, consequently, the position of the heat-conducting element 25 can be fixed in a defined manner in terms of height. Such a configuration dispenses with the need for troublesome screwing openings in the side wall of the sheet-metal cup 7 and allows the openings that are always already present in the base of the sheet-metal cup to be used. Alternatively, the heat-conducting element 25 may, however, also be screwed to the outer wall of the sheet-metal cup 7 in the region of the fitting openings 47. It is also possible to fasten in the fitting openings 47 a non-illustrated connection part, to which, on one hand, the electrical sensor lines 30 of the temperature sensor 29 can be connected, for example, can be plugged on, and to which, on the other hand, electrical connecting lines of a control unit 101 (FIG. 6) of the cooktop 1 are connected. Such a configuration provides reliable strain relief for the sensor lines 30. It is also to be ensured by the connection part that the electrical connections of the PT temperature sensor 29 are insulated from ground and from the grounded shroud support 37. The temperature sensor and the sensor lines 30 are covered on the top side over their entire length by the heat-conducting element 25. For better guidance of the lines 30, they may be adhesively attached on the underside of the element 25 in the region of the shroud support 37 and/or be held by guiding elements formed on the support 37.

Furthermore, the fitting plate 45 has a flat pin 49, on which a ground line 51 or its standardized AMP plug of the cooktop can be directly fitted. As a result, the heat-conducting element 25 is connected to ground potential. It must be ensured, in such a case, that the ohmic resistance of the element 25 lies at a value of 0.1 ohm or less, to be able to withstand a continuous current load of at least 25 A. Furthermore, the heat-conducting element 25 must also not be made too rigid, to allow it to yield suitably under mechanical loading or movement of the cooktop panel 3. Otherwise, excessively rigid abutment of the element 25 or the element shroud 27 against the cooktop panel 3 would give rise to the risk of the cooktop panel flaking away on the underside of the panel 3 or possibly even of it breaking. It should also be noted that an improvement in the heat conduction from the underside of the cooktop panel 3 to the heat-conducting element 25 could be achieved if the intermediate spaces between the studs formed on the underside of the glass-ceramic panel are filled with a heat-conducting paste or a suitable adhesive.

Figure 4:
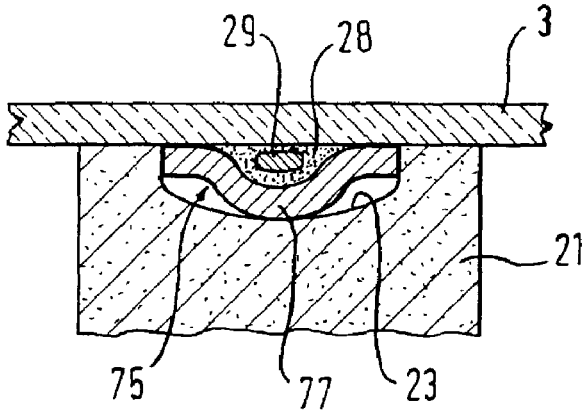
FIG. 4 is a simplified, fragmentary, cross-sectional view of a portion of a second embodiment of the heating element of FIGS. 1 and 2.

In the case of the cooktop or the heating element according to a second exemplary embodiment, the same reference numerals as in the case of the description of the first exemplary embodiment are used wherever possible for reasons of simplicity. In FIG. 4, the region of the cooktop in which the temperature sensor 29 is disposed together with a heat-conducting element 75 in the region of the insulating block 21, in a way similar to the first exemplary embodiment, is shown as a portion in a sectional representation transversely with respect to the longitudinal extent of the element and, consequently, approximately perpendicularly with respect to the line I-I in FIG. 2. By contrast with the first exemplary embodiment, the heat-conducting element 25 has no element shroud, but instead an element shell 77. The element shell 77 is likewise disposed in a suitable receiving depression 23 of the insulating block 21. The insulating shell lies in its edge regions in an annular area directly against the underside of the glass-ceramic panel 3 and, as a result, is in heat-conducting connection with the panel 3. Disposed in the element shell 77 is the temperature sensor 29, the shell additionally being filled by a heat-conducting paste. The heat-conducting element 75, which is not shown in any more detail, could otherwise be formed in the same way as the heat-conducting element 25 of the first exemplary embodiment. For technical safety reasons, however, the temperature sensor 29 is operated with a safety extra-low voltage or transmits its measuring signal contactlessly from the heating element.

According to the third exemplary embodiment as shown in FIG. 5, the heat-conducting element 85, shaped, for example, in the form of a shroud, has an element shroud 87, which corresponds to that of the first exemplary embodiment. By contrast with the first exemplary embodiment, however, a fitting portion 89 of the shroud support 37 is not disposed radially offset laterally with respect to the receiving portion of the element shroud 87. Rather, the fitting portion 89 extends vertically downward as a continuation of the element shroud 87 without any radial offset along the outer wall of the sheet-metal cup 7. In FIG. 5 it is schematically represented in which area region A the heat-conducting element 85 is thermally in contact with the underside of the cooktop panel 3. The size of the area is, in such a case, approximately 50 to 100 $mm^2$. It is also represented that the contact area A is approximately about 10 times larger than a base area B of the temperature sensor 29. As a result, it is ensured, inter alia, that the temperature sensor does not determine the temperature on the underside of the cooktop panel, as it were, at a point, but in an integrating manner over a relatively large area region. This is important, in particular, because the respective pan diameter and the nature of its bottom are not precisely known and, in addition, may vary from pan type to pan type. A minimum lateral distance a of the element 85 from the edge region of the insulating material 21 is about 8 mm. Such a configuration provides an optimum geometry, which has the following advantages for the accurate control of the heating power or the temperature, in particular, in the case of frying of braising operations in pans 6 placed on the cooktop panel 3. The temperature sensor 29 and the element shroud 27 are, on one hand, adequately shielded by the insulating block 21 against the thermal radiation emanating from the strip heating conductor 15. On the other hand, the insulating block is still small enough to be able to avoid disadvantageous shadowing of the vessel bottom 6 during heating or frying/braising, and the resultant undesirably uneven heat distribution in the bottom of the pan. In particular, the heat-conducting element 25 is still thermally coupled adequately well to the region of the cooktop panel that is heated directly by the thermal radiation of the heating device 15. This is achieved, moreover, in the case of the first and third exemplary embodiments, the temperature sensor 29 at the same time being covered with respect to the cooktop panel 3 by a grounded protective element 27, while conforming to the 4 mm clearance and 8 mm leakage distance required by regulations. It is also achieved by the enlargement of the area thermally in contact with the underside of the cooktop panel 3 that, in spite of all assembly/fitting tolerances, adequately good thermal contact is established between the temperature sensor, of a smaller surface area, and the cooktop panel 3. This is important, in particular, whenever a glass-ceramic cooktop panel 3 that is studded on the underside is used and the geometry of the studs is of the same order of magnitude as the temperature sensor 29. The above statements concerning the shaping of the geometries, distances, and relative sizes apply to all three exemplary embodiments. If appropriate, the measuring area A is coupled by a high-temperature lubricant to the underside of the cooktop panel, which is, in particular, of glass-ceramic material to achieve improved heat transfer and improved damping under impact loading.

Figure 6:
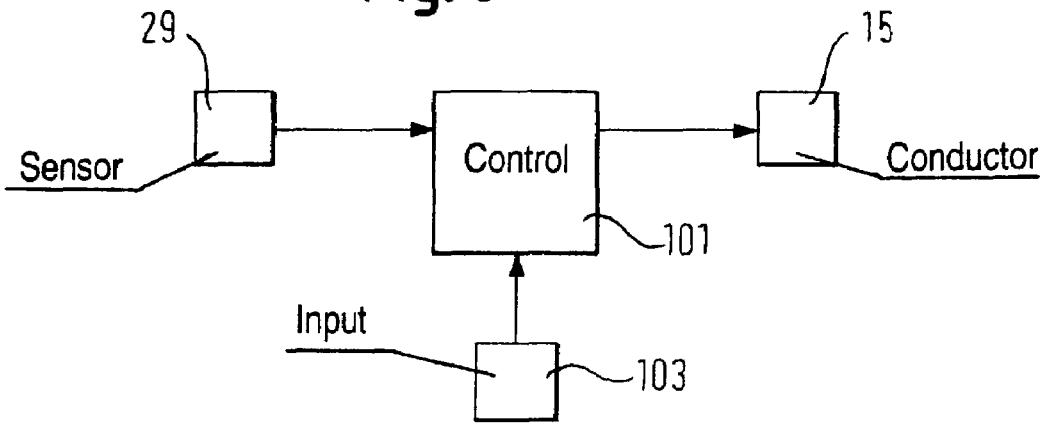
FIG. 6 is a block circuit diagram of the cooktop according to the invention.

A block diagram that shows the most important components of the cooktop is schematically shown in FIG. 6. The control unit 101 regulates the heating power of the strip heating conductor 15 in a way corresponding to the measured values of the temperature sensor 29 to the setpoint value predetermined by an input unit 103. The configuration achieves the effect, in particular, that burning during frying/braising is virtually ruled out.

We claim:

1. A cooktop, comprising:

a cooktop panel having an underside;

at least one heating element having an outer circumferential wall and being disposed beneath said cooktop panel for heating up a cooking vessel to be placed on said cooktop panel;

a control unit electrically connected to said at least one heating element for controlling a heating power of said at least one heating element;

a temperature sensor sensing a temperature of said cooktop panel, said temperature sensor:

being in heat-conducting contact with said underside of said cooktop panel within said at least one heating element; and being electrically connected to said control unit;

a heat-conducting element fastened at a region of said outer circumferential wall and having a portion at least partially disposed within said at least one heating element, said portion being in heat-conducting contact with said underside of said cooktop panel at a region of said cooktop panel; and said temperature sensor being fastened to said heat-conducting element in said region of said cooktop panel.

2. The cooktop according to claim 1, wherein:

said heat-conducting element is screwed onto said region of said outer circumferential wall.

3. The cooktop according to claim 1, wherein:

a screw fastens said heat-conducting element onto said region of said outer circumferential wall.

4. The cooktop according to claim 1, wherein said heat-conducting element is selectively fastened on said outer circumferential wall at various heights.

5. The cooktop according to claim 1, wherein:

said heat-conducting element has an underside; and said temperature sensor is fastened on said underside of said heat-conducting element.

6. The cooktop according to claim 1, wherein:

said at least one heating element has a temperature limiter; and said temperature sensor is disposed in a region of said temperature limiter.

7. The cooktop according to claim 1, wherein said heat-conducting element is electrically conductive and grounded.

8. The cooktop according to claim 1, wherein:

said at least one heating element has a heater emanating thermal radiation; and insulating material shields said temperature sensor and said heat-conducting element against the thermal radiation.

9. The cooktop according to claim 1, wherein:

said temperature sensor has at least one electrical line; and said heat-conducting element has a line connection portion connected to said at least one electrical line.

10. The cooktop according to claim 9, wherein said heat-conducting element has a ground line and a ground connection portion connected to said ground line for grounding said heat-conducting element.

11. The cooktop according to claim 1, wherein said heat-conducting element has a ground line and a ground connection portion connected to said ground line for grounding said heat-conducting element.

12. A cooktop, comprising:

a cooktop panel having an underside;

at least one heating element disposed beneath said cooktop panel for heating up a cooking vessel to be placed on said cooktop panel;

a control unit electrically connected to said at least one heating element for controlling a heating power of said at least one heating element;

a temperature sensor sensing a temperature of said cooktop panel, said temperature sensor:

being in heat-conducting contact with said underside of said cooktop panel within said at least one heating element; and being electrically connected to said control unit;

a heat-conducting element having a portion at least partially disposed within said at least one heating element, said portion being in heat-conducting contact with said underside of said cooktop panel at a region of said cooktop panel, and said heat-conducting element having a receiving portion receiving said temperature sensor, a fitting portion for fastening said heat-conducting element, and said receiving portion being radially offset laterally with respect to said fitting portion; and said temperature being sensor fastened to said heat-conducting element in said region of said cooktop panel.

13. The cooktop according to claim 12, wherein:

said at least one heating element has an outer circumferential wall; and said heat-conducting element is fastened at a region of said outer circumferential wall.

14. The cooktop according to claim 12, wherein said fitting portion fastens said heat-conducting element on said at least one heating element.

15. A cooktop, comprising:

a cooktop panel having an underside;

at least one heating element disposed beneath said cooktop panel for heating up a cooking vessel to be placed on said cooktop panel;

a control unit electrically connected to said at least one heating element for controlling a heating power of said at least one heating element;

a temperature sensor sensing a temperature of said cooktop panel, said temperature sensor:

being in heat-conducting contact with said underside of said cooktop panel within said at least one heating element; and being electrically connected to said control unit;

a heat-conducting element having a portion at least partially disposed within said at least one heating element, said portion being in heat-conducting contact with said underside of said cooktop panel at a region of said cooktop panel;

said heat-conducting element having at least two parts, one of said at least two parts being a receiving part receiving said temperature sensor, said receiving part being of a first material, and another of said at least two parts being of a second material harder than said first material; and said temperature sensor being fastened to said heat-conducting element in said region of said cooktop panel.

16. The cooktop according to claim 15, wherein said first material is spring steel.

17. A cooktop, comprising:

a cooktop panel having an underside;

at least one heating element disposed beneath said cooktop panel for heating up a cooking vessel to be placed on said cooktop panel;

a control unit electrically connected to said at least one heating element for controlling a heating power of said at least one heating element;

a temperature sensor sensing a temperature of said cooktop panel, said temperature sensor:

being in heat-conducting contact with said underside of said cooktop panel within said at least one heating element; and being electrically connected to said control unit;

a heat-conducting element being a torsion spring having a torsion region substantially outside said at least one heating element, said heat-conducting element having a portion at least partially disposed within said at least one heating element, said portion being in heat-conducting contact with said underside of said cooktop panel at a region of said cooktop panel; and said temperature sensor being fastened to said heat-conducting element in said region of said cooktop panel.

18. In a cooktop having a cooktop panel with an underside, at least one heating element having a circumferential wall and being disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel, in heat-conducting contact with the underside of the cooktop panel within the at least one heating element, and electrically connected to the control unit, a temperature sensor holder comprising:

a heat-conducting element fastened at a region of the outer circumferential wall and having a portion at least partially disposed within the at least one heating element, said portion being in heat-conducting contact with the underside of the cooktop panel at a region of the cooktop panel; and the temperature sensor being fastened to said heat-conducting element in the region of the cooktop panel.

19. The temperature sensor holding according to claim 18, wherein said heat-conducting element is a removable part of the at least one heating element.

20. In a cooktop having a cooktop panel with an underside, a control unit, and a temperature sensor in heat-conducting contact with the underside of the cooktop panel, electrically connected to the control unit, and sensing a temperature of the cooktop panel, a heater comprising:

at least one heating element having a circumferential wall:

disposed beneath the cooktop panel for heating up a cooking vessel to be placed on the cooktop panel; and electrically connected to the control unit for controlling a heating power of said at least one heating element;

the temperature sensor being in heat-conducting contact with the underside of the cooktop panel within said at least one heating element;

a heat-conducting element fastened at a region of said outer circumferential wall and having a portion at least partially disposed within said at least one heating element, said portion being in heat-conducting contact with the underside of the cooktop panel at a region of the cooktop panel; and the temperature sensor being fastened to said heat-conducting element in the region of the cooktop panel.

* * * * *